US008586850B1

(12) United States Patent
Turner

(10) Patent No.: US 8,586,850 B1
(45) Date of Patent: Nov. 19, 2013

(54) PICKUP FOR STRINGED MUSICAL INSTRUMENTS AND RELATED METHODS OF USE

(76) Inventor: Robert Turner, Santa Rosa, CA (US)

( * ) Notice: Subject to any disclaimer, the term of this patent is extended or adjusted under 35 U.S.C. 154(b) by 0 days.

(21) Appl. No.: 13/556,467

(22) Filed: Jul. 24, 2012

(51) Int. Cl.
*G10H 3/18* (2006.01)
*G10H 1/32* (2006.01)
*G10H 3/00* (2006.01)

(52) U.S. Cl.
USPC ..... 84/726; 84/743

(58) Field of Classification Search
USPC ..... 84/726, 743
See application file for complete search history.

(56) References Cited

U.S. PATENT DOCUMENTS 3,780,202 A * 12/1973 Law ..... 84/726
3,983,777 A * 10/1976 Bartolini ..... 84/726
3,992,972 A * 11/1976 Rickard ..... 84/743
4,096,780 A * 6/1978 Dawson ..... 84/726
4,495,641 A * 1/1985 Vernino ..... 381/91
4,535,668 A * 8/1985 Schaller ..... 84/727
4,809,578 A * 3/1989 Lace, Jr. ..... 84/726
5,438,158 A * 8/1995 Riboloff ..... 84/727
5,614,688 A * 3/1997 Donnell ..... 84/743
5,767,431 A * 6/1998 Khanagov ..... 84/726
5,831,196 A * 11/1998 Khanagov ..... 84/726
6,043,422 A * 3/2000 Chapman ..... 84/723

* cited by examiner

*Primary Examiner* — Jeffrey Donels
(74) *Attorney, Agent, or Firm* — Buche & Associates, P.C.; John K. Buche

(57) ABSTRACT

Disclosed is a pickup assembly for stringed musical instruments with improved acoustic sound quality, and related methods. In one embodiment, the pickup features, three mechanisms for converting the mechanical vibrations of the instrument into an electric signal: first, a mechanism for converting the vibrations of the instruments strings into an electric signal; second, a acoustic chamber mechanism for converting the vibrations of the sound box (e.g. sound waves) into an electric signal; and third, a mechanism for converting the vibrations of the instruments head into an electric signal.

20 Claims, 8 Drawing Sheets

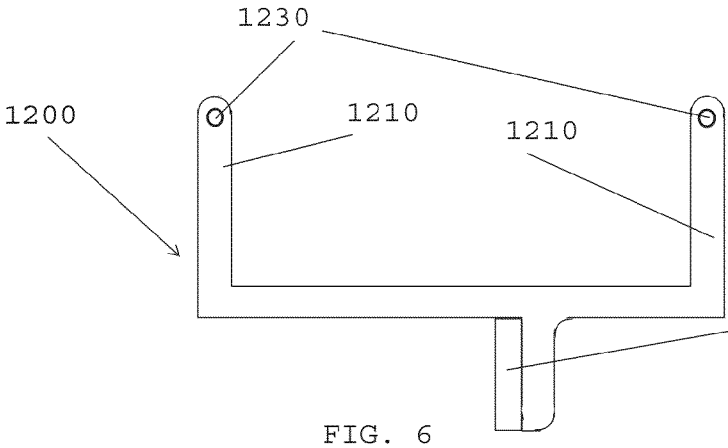
FIG. 6
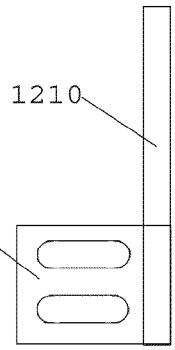
FIG. 7
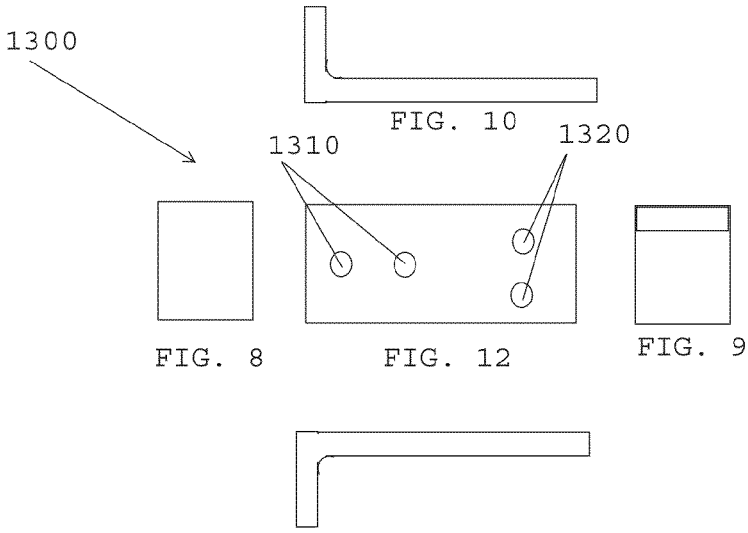
FIG. 10
FIG. 8
FIG. 12
FIG. 9
FIG. 11

PICKUP FOR STRINGED MUSICAL INSTRUMENTS AND RELATED METHODS OF USE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of Invention

The present application is in the field of music technology and particularly relates to pickups for stringed musical instruments.

2. Background of the Invention

In the field of music technology, a pickup is a transducer for sensing mechanical vibrations and converting the same into an electrical signal that may be amplified or broadcast before being converted to audible sound. Magnetic or electromagnetic pickups, which are magnets coiled with an electric conductor, are a common type of pickup. Magnetic pickups convert the mechanical vibration of soft-magnetic elements of a musical instrument into an electric current via the vibrations modulating the pickup's magnetic flux to produce an alternating electric current in the coiled electric conductor. In stringed musical instruments, magnetic pickups have typically been used to convert the vibrations of metallic strings into an electric signal for amplification or broadcast.

Sometimes, magnetic pickups for stringed instruments are not entirely satisfactory for amplifying or broadcasting the sound of the instrument. One unsatisfactory aspect of ordinary magnetic pickups is that the sound resulting from the electric signal of such pickups does not always sound natural. Frequently, the unnatural sounds result from the inability of the pickups to sense the vibrating elements of the instrument which are not capable of modulating the pickups' magnetic fluxes (e.g., non-metallic elements), because said vibrating elements may acoustically produce sound. What is more, the vibrating elements which are not sensed by the pickups may nevertheless affect the sound quality ultimately produced from the pickups' electric signal by causing feedback at high output levels (such as those produced in live performances). As a result, the sound produced from such pickups is deficient in an "air" or acoustic quality. Another unsatisfactory aspect of ordinary magnetic pickups is that they are frequently positioned adjacent to the strings of the musical instrument and, as a result, can become a visual distraction to both a musician and the musician's audience. In view of the foregoing, a need exists for magnetic pickups with improved acoustic quality, wherein the pickups are positioned on an instrument in a non-distracting manner.

SUMMARY OF THE INVENTION

It is an object of this disclosure to describe magnetic pickups with improved acoustic quality over heretofore known magnetic pickups. In one embodiment, the pickup comprises: a first magnet coiled by a first electric conductor; a second magnet coiled by a second electric conductor; a first, a second, and third acoustic chamber; wherein the first magnet is positioned between the first and second acoustic chambers, wherein the second magnet is positioned between the second and third acoustic chambers, and wherein the first and second magnets are shiftable relative to one another; and, a soft-magnetic element positioned on an acoustic element of a musical instrument to which the pickup is attached.

It is another object of this disclosure to describe methods of improving the acoustic quality of electronic sounds. In one exemplary method, the above described pickup assembly comprises the steps of: securing the pickup assembly to a stringed musical instrument inside of a sound box of the instrument; securing the soft magnetic element to an acoustic element of the musical instrument so that said element moves relative to one of the first or second magnets whenever the instrument is played; playing the musical instrument so that any of the following modulate the magnetic flux of either the first or second magnet to produce an electric current in either the first or second coiled electric conductor—(a) the vibrations of the instrument's strings—(b) the movement of said soft magnetic element—or (c) the relative movement of the first and second magnets with respect to one another resulting from the introduction of sound waves into and of the first, second, or third acoustic chambers. In another method, the sound quality may be improved by practicing the above described method with one of the first, second or third acoustic chambers being blocked or removed from the pickup assembly.

Other objectives and desires may become apparent to one of skill in the art after reading the below disclosure and viewing the associated figures.

BRIEF DESCRIPTION OF THE FIGURES

The manner in which these objectives and other desirable characteristics can be obtained is explained in the following description and attached figures in which:

FIG. 6 is a top view of the cradle of FIG. 2;

FIG. 7 is a side view of the cradle of FIG. 2;

FIG. 8 is a top view of a mounting bracket of FIG. 2;

FIG. 9 is a bottom view of the mounting bracket of FIG. 2;

FIG. 10 is a left side view of the mounting bracket of FIG. 2;

FIG. 11 is a right side view of the mounting bracket of FIG. 2;

FIG. 12 is a front view of the mounting bracket of FIG. 2; and,

It is to be noted, however, that the appended figures illustrate only typical embodiments of the disclosed assemblies, and therefore, are not to be considered limiting of their scope, for the disclosed assemblies may admit to other equally effective embodiments that will be appreciated by those reasonably skilled in the relevant arts. Also, figures are not necessarily made to scale.

DETAILED DESCRIPTION OF PREFERRED EMBODIMENTS

In general, disclosed is a pickup assembly for stringed musical instruments with improved acoustic sound quality, and related methods. In one embodiment, the pickup features, three mechanisms for converting the mechanical vibrations of the instrument into an electric signal: first, a mechanism for converting the vibrations of the instruments strings into an electric signal; second, a acoustic chamber mechanism for converting the vibrations of the sound box (e.g. sound waves) into an electric signal; and third, a mechanism for converting the vibrations of the instruments head into an electric signal. The more specific aspects and modes of operation of the disclosed pickup assembly are further disclosed below in connection with the attached figures.

Figure 1:
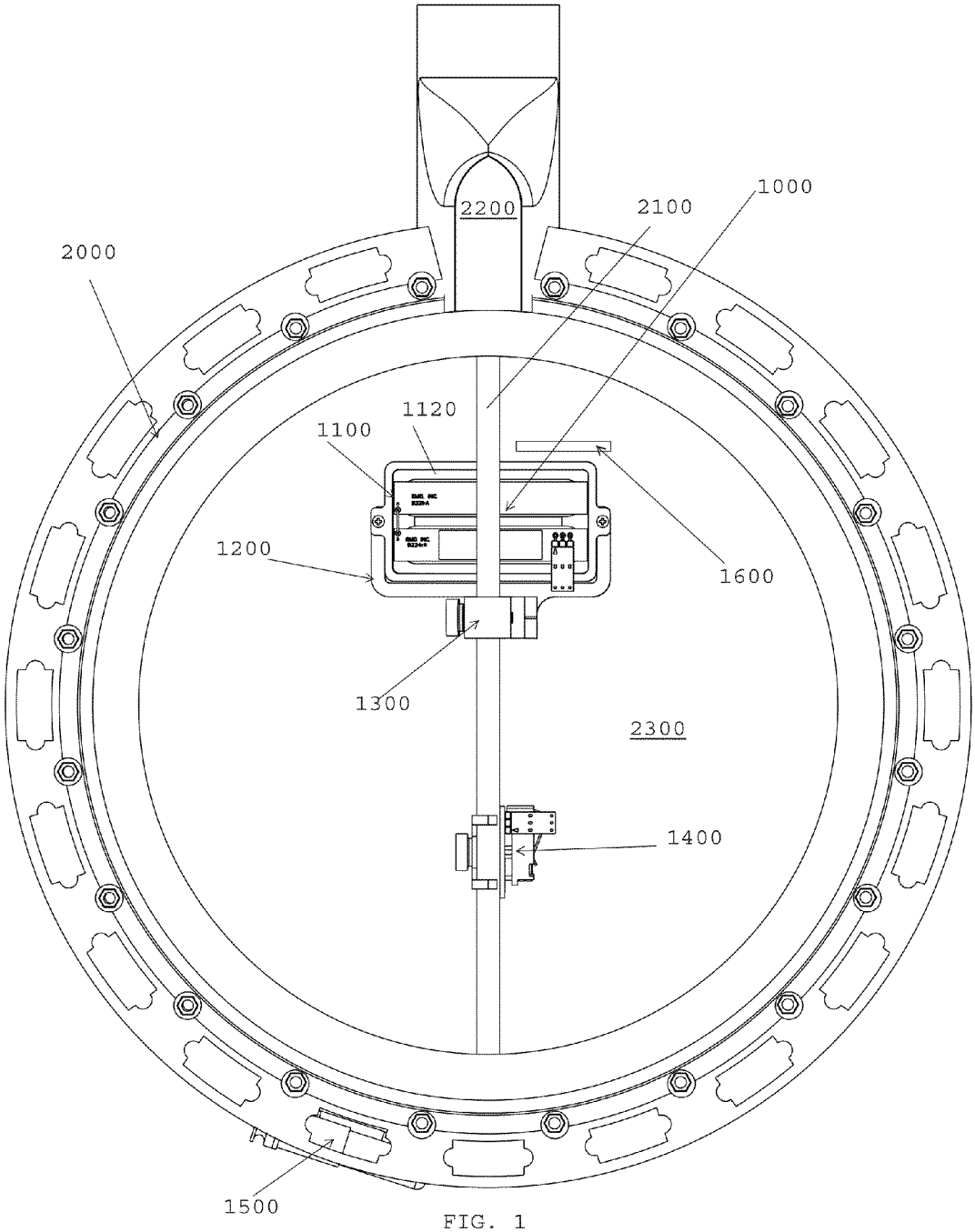
FIG. 1 is a perspective view of a musical instrument with a pickup assembly installed thereon.

FIG. 1 is a top view of a stringed musical instrument 2000 with a pickup assembly 1000 installed thereon its coordinating neck extension rods 2100, which extend from the neck 2200 and through the sound box 2300 of the instrument. Although the depicted instrument 2000 appears to be a banjo, the depicted instrument 2000 may be replaced by any acoustic steel stringed instrument with or without neck extension rods while not departing from the spirit and intent of this application. As shown in FIG. 1, the installed pickup assembly comprises six components: (1) a pickup 1100; (2) a cradle 1200; (3) a mounting bracket 1300; (4) a electronics assembly 1400; (5) a jack 1500; and (6) a soft-magnetic element 1600.

Figure 2:
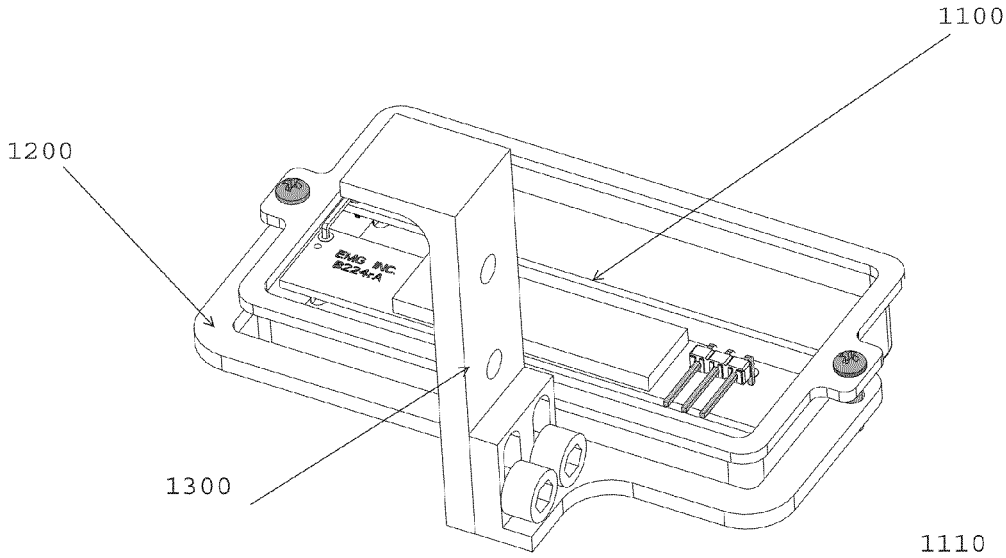
FIG. 2 is a top view of a pickup, a cradle, and a mounting bracket.
Figure 3:
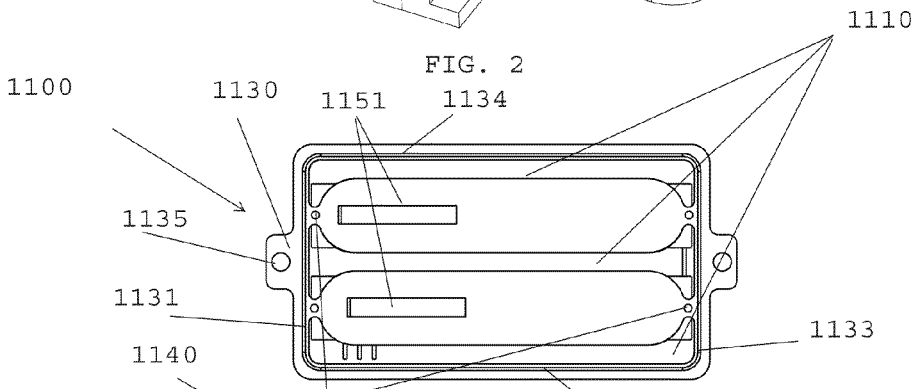
FIG. 3 is a bottom view of the pickup of FIG. 2.
Figure 4:
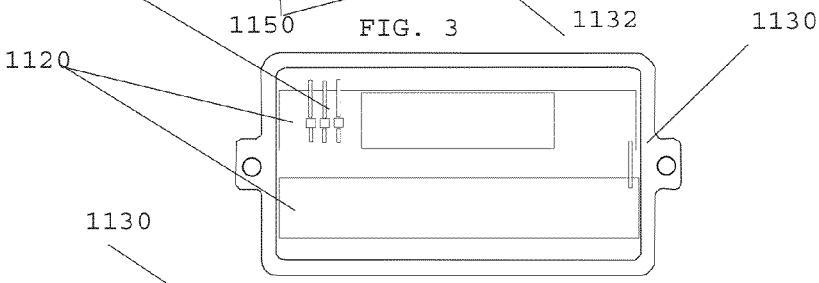
FIG. 4 is a top view of the pickup of FIG. 2.
Figure 5:
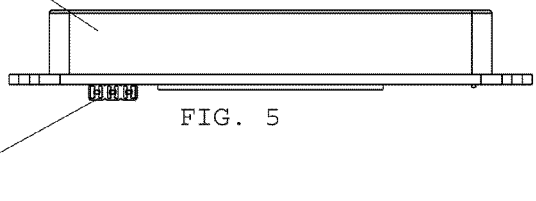
FIG. 5 is a side view of the pickup of FIG. 3.

FIG. 2 is a perspective view of the pickup 1100, the cradle 1200, and the mounting bracket 1300. FIGS. 3 through 5 respectively disclose top, bottom, and side views of the pickup 1100. FIGS. 6 and 7 show top and side views of the cradle. FIGS. 8 through 12 depict top, bottom, left side, right side, and front views of the mounting bracket 1300.

Referring to FIGS. 2 and 3 through 5, the pickup 1100 may be generally defined by: three acoustic chambers 1110 separated by two electromagnets 1120 that are shift able relative to one another; and electric circuitry 1140 for extracting electric signals from the electromagnets 1120 and for, in some embodiment, rendering the pickup 1100 "active." In a preferable embodiment, the acoustic chambers 1110 and electro magnets 1120 are positioned within a housing 1130. Referring to FIGS. 2 and 3, the housing may suitably be defined by four walls 1131, 1132, 1133, 1134 so that the acoustic chambers and electro magnets are alignedly positioned between the walls so that: one of said chambers 1110 is defined by three walls 1131, 1132, 1133 and a side of one electromagnet 1120; one of said chambers 1110 is defined by two walls 1131, 1133 and one side of each electromagnet 1120 length; and one of said chambers is defined by three walls 1131, 1133, 1134 and a side of an electro magnet 1120. Referring to the same figures, the housing 1130 of the pickup 1100 further features apertures 1135 on opposite sides 1131, 1133. In one embodiment, the pickup features: rectangular holes 1151 in the housing for providing greater exposure to the electromagnets to soft magnetic materials (e.g., the strings of the instrument); and holes 1150 to allow greater coil vibrations.

Yet still referring to FIGS. 2 and 3 through 5, in one embodiment, the housing may generally define an open rectangular box, 2.875 inches (length (side walls 1132, 1134))× 1.625 inch (width (side walls 1131, 1133))×0.560 inch (height (all side walls)). In said embodiment, the apertures 1135 positioned along the width of said housing 1130 at a distance of 3.048 inches apart from center to center. In the same embodiment, the electromagnets 1120 may be positioned along the length of the housing 1130 so that there is a gap of 0.125 between the two electromagnets 1120 and the electromagnets 1120 and the side walls 1132, 1134. In a preferred embodiment of the pickup 1100: the electromagnet is a coiled magnet (e.g., Alnico or Ceranae magnets) and the housing 1130 is formed of molded plastic.

Referring to FIGS. 6 and 7 the cradle 1200 generally defines a receptacle for the pickup 1100. Referring to the figure, the cradle 1200 is defined by two arms 1210 and a double-aperture system 1220 for receiving two bolts. Still referring to the figures, the arms 1210 generally extend outwardly, forwardly and transversely from the double aperture system 1220. At the end of both arms are apertures 1230. Referring to FIGS. 2 and 6, the arms 1210 of the cradle 1200 are configured to receive the pickup 1100 so that each arm 1210 may be coupled to opposite sides 1131, 1133 of the pickup 1100, via a screw through the apertures 1135, 1230 in the arms of the cradle and housing of the pickup. In one preferred embodiment, the cradle 1200 may be formed of molded plastic.

Referring to FIGS. 8 through 12, the mounting bracket 1300 is an upside down "L" shape. On one side, the mounting bracket 1300 features two apertures 1310 aligned vertically and two apertures 1320 aligned horizontally. As discussed later below: (a) the two horizontally aligned apertures 1320 are adapted to each receive a bolt after said bolts have been passed through the apertures in the double-aperture system 1220 of the cradle 1200 whereby the mounting bracket 1300 and cradle 1200 are secured to one another; and (b) the two vertically aligned apertures may each receive a bolt for securing the mounting bracket 1300 to the neck extension of a musical instrument.

Referring to FIG. 1 the soft-magnet element 1600 may preferably be a thin strip of metallic material. In one embodiment the soft magnetic element 1600 is a strip of steel shim stock (approx. 0.002 inches thick). As discussed later below, the soft-magnetic element 1600 may be coupled to the head of an instrument so that the vibrations of the head may produce an electric signal in the pickup 1100.

Figure 13A:
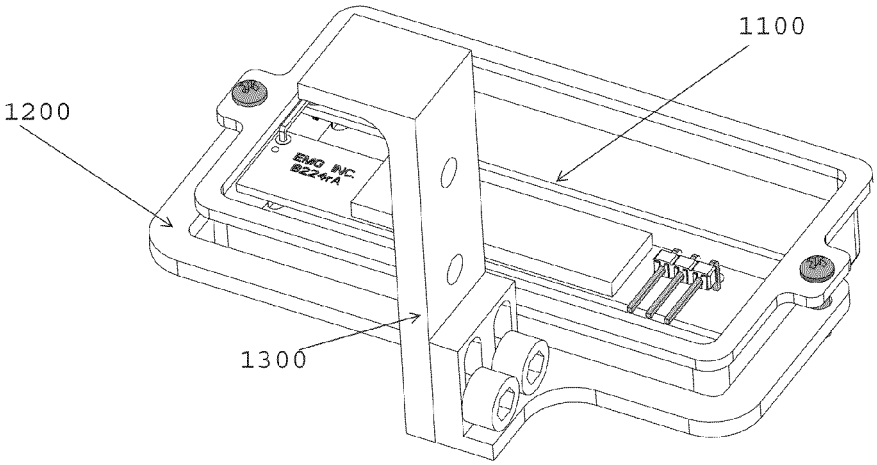
FIG. 13A through 13L illustrate the installation of the pickup, cradle, and mounting bracket to the musical instrument of FIG. 1.
Figure 13B:
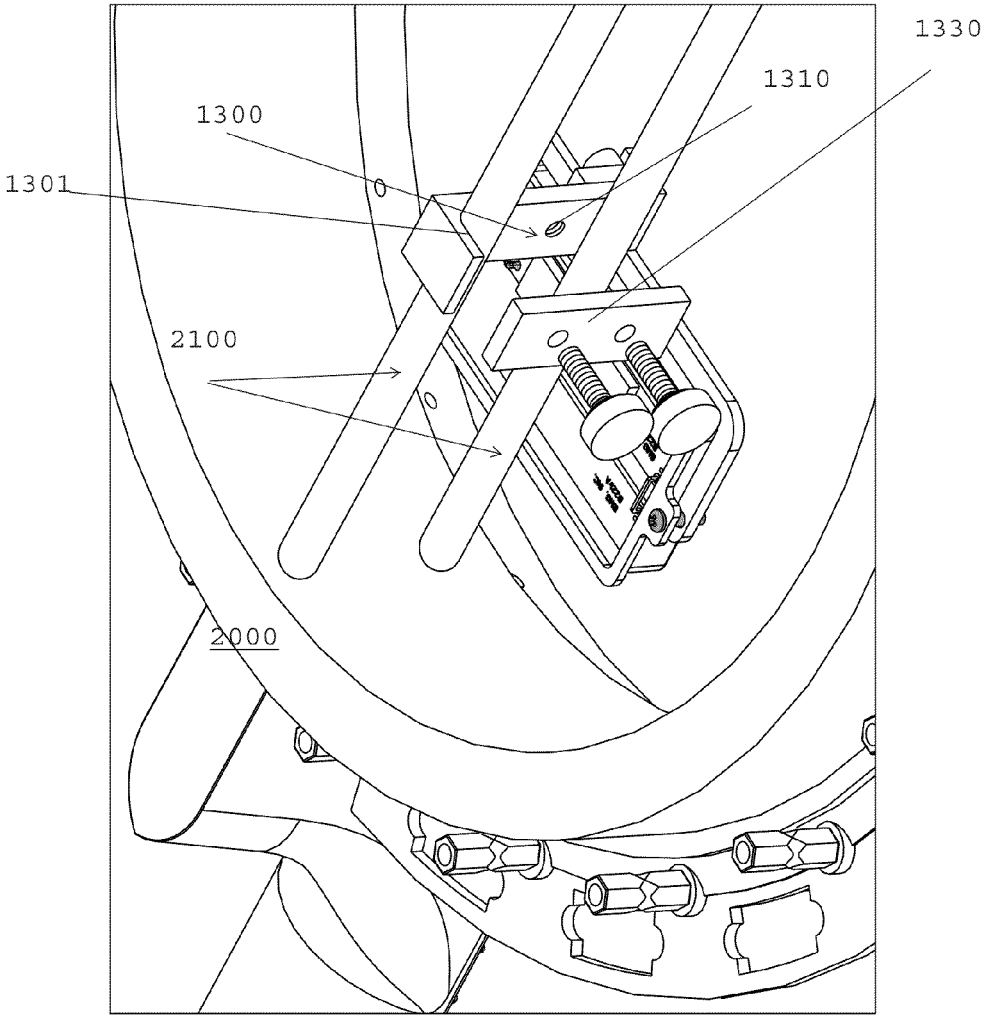
Figure 13C:
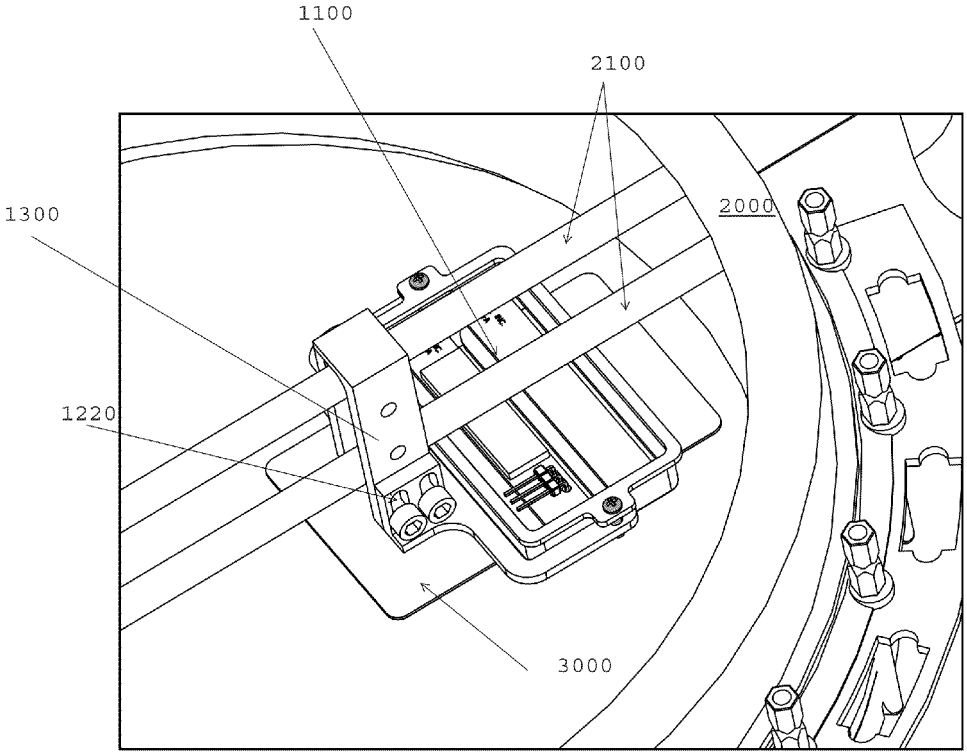

FIG. 13A through 13C illustrate the installation of the pickup 1100, cradle 1200, mounting bracket 1300 to the musical instrument of FIG. 1. First, as shown in FIGS. 13A and 2 through 12, the pickup 1100 is provided to the cradle 1200 so that the pickup is positioned between the arms 1210 thereof and so that the apertures 1135 of the pickup 1100 align with the apertures 1230 of the arms 1210 of the cradle. Second, screws are provided through the apertures 1135, 1230 for securing the cradle 1200 and pickup 1100. Third, the mounting bracket 1300 is positioned adjacent to the double-aperture system of the cradle 1200 so that the horizontally aligned apertures 1320 align with the double aperture system as shown in FIG. 13A. Fourth, screws are loosely provided through the double aperture system for securing the mounting bracket to the cradle. Preferably, the screws for securing the mounting bracket and cradle are loose so that positioning of the cradle may be adjusted.

Referring to FIG. 13B, the mounting bracket 1300 may be secured to the neck extension 2100 of the musical instrument 2000. In a preferred embodiment, the upside down "L" shaped mounting bracket 1300 may be positioned so that the "L" hooks over one of the coordinating neck extension rods 2100. Suitably, a plate 1330 and screws may be used to clamp the mounting bracket to the rods 2100 via the vertically aligned apertures 1310 so that the mounting bracket 1300 sits flat on the top rod. In one embodiment, the mounting bracket is positioned so that its side that is furthest away from the pickup 1301 is 3.750 its inches from the neck 2200 of the musical instrument. When so positioned, the pickup is positioned underneath the strings and within the sound box of the instrument and, as a result, capable of sensing the vibrations of the strings and sound box via the magnets and acoustic chambers respectively.

Referring now to FIG. 13C, the position of the pickup relative to the guitar's head may be adjusted for optimal sensing of the vibrations of the strings, head, and sound box of the musical instrument 2000. In one mode of positioning, a spacer 3000 of about 0.030 inches thick (e.g., a credit card) is positioned underneath the pickup 1100 and the screws through the double aperture system 1220 are tightened so that the cradle 1200 and pickup are firmly secured to the mounting bracket 1300. Suitably, the spacer 3000 may be removed so that there is no contact between the pickup 1100 and head of the musical instrument.

Figure 13D:
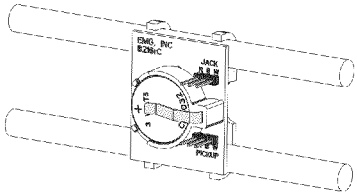
Figure 13E:
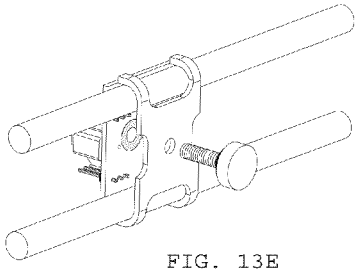
Figure 13F:
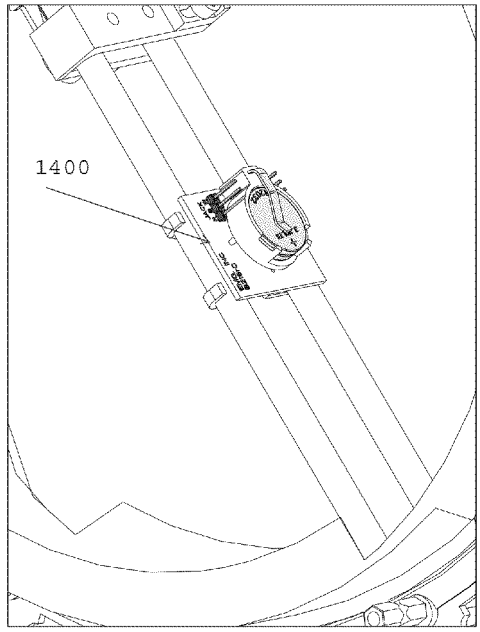

FIGS. 13D through 13F illustrate installation of the battery assembly 1400. Referring to those figures, the electronics assembly 1400 may be installed for providing a battery 1410. Suitably, the electronics assembly may be clamped on the neck extension rods 2100 of the musical instrument 2000 via screws and a mounting bracket as shown in FIG. 13E. Suitably, two CR2032 lithium batteries may be provided to the battery receptacle with the positive of the batteries facing outwardly.

Figure 13G:
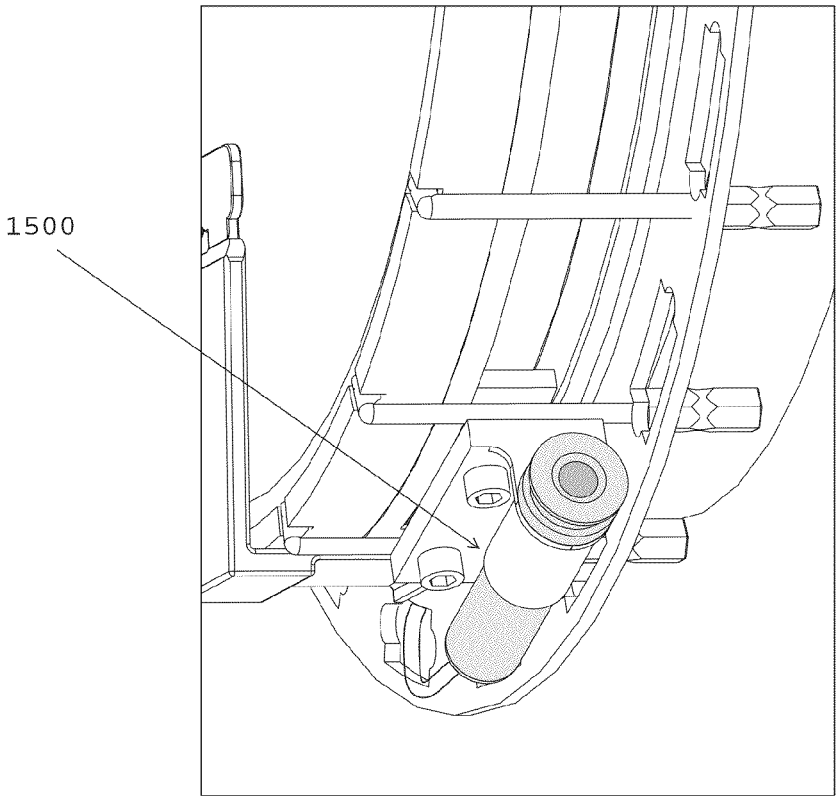
Figure 13H:
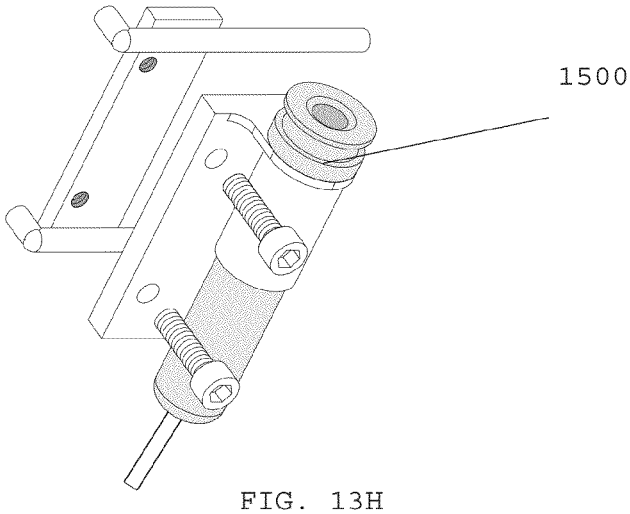

FIGS. 13G and 13H illustrate the installation of an output Jack. As shown in the figures, the output jack 1500 may suitably be installed on the outside of the instrument via clamping the jack 1500 to the lugs with two screws and a mounting bracket.

Figure 13I:
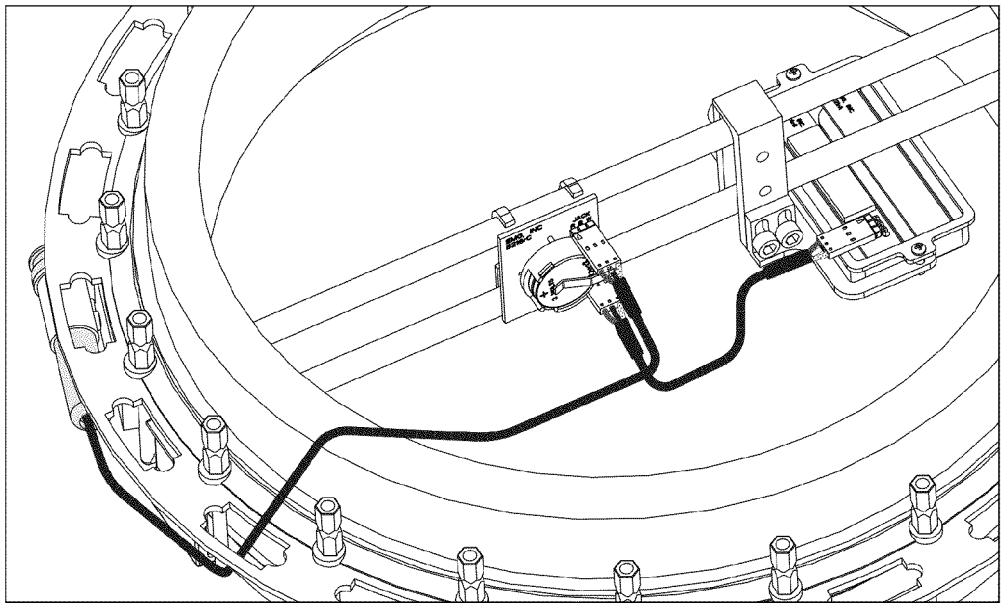
Figure 13J:
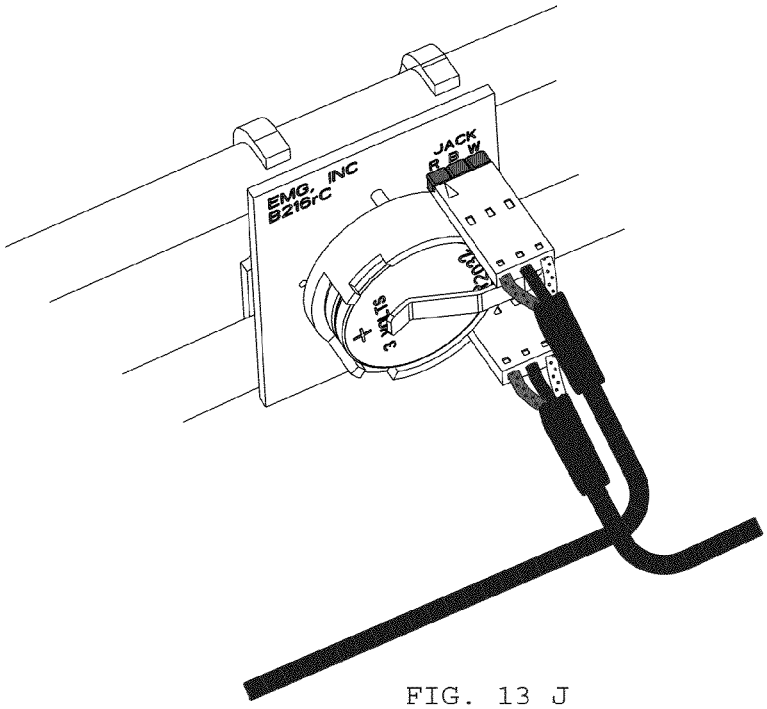

Suitably, the output jack and electronics assembly may be electrically coupled to the pickup for extracting electric signals therefrom. Referring to FIGS. 13I and 13J cables may be provided between (a) the jack 1500 and electronics assembly 1400 and (b) the pickup 1100 and electronics assembly 1400. Those of skill in the art will know well circuit diagrams for the electronics for accomplishing extraction of electronic signals from the pickup via the output jack 1500.

Figure 13K:
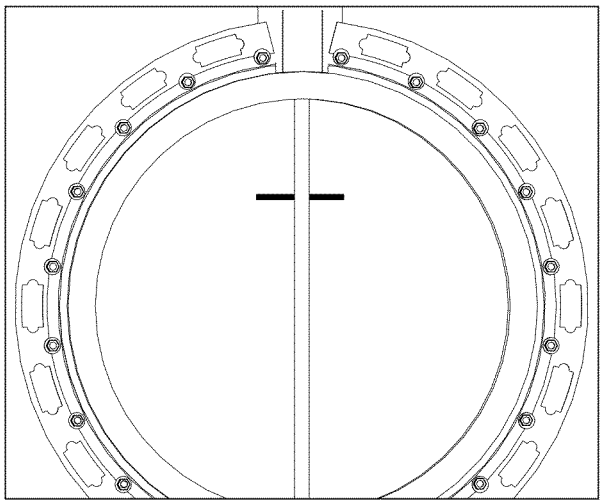
Figure 13L:
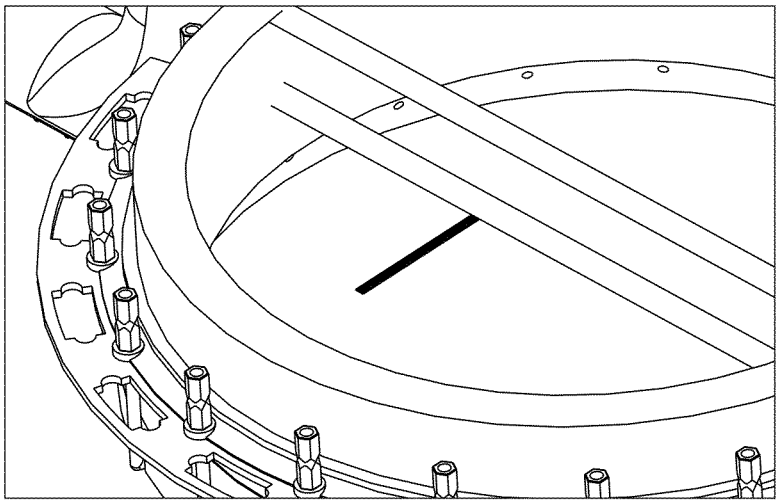

As alluded to above, the pickup assembly 1000 features a mechanism for converting the vibrations of the instrument's 2000 head into an electric signal. In one embodiment, a soft magnetic element 1600 may be secured to the head 2300 so that the vibrations of the head may modulate the magnetic flux of the pickup. FIGS. 13K and 13L illustrate installation of the soft magnetic element 1600. In one embodiment, a strip of 0.002 inch thick steel shim stock may be removably adhered to the head of the musical instrument. Suitably, the steel strip may be installed on either the inside or outside of the head. Masking tape or other transfer light adhesive may suitably be used for adhering the strip to the head.

In one embodiment, a preferred placement of the soft magnetic element is directly over either magnet. In another embodiment, the element 1600 may be positioned a location on the head so that it is in between the magnets of the pickup. Additional soft magnetic elements may also be positioned on the head so that vibrations thereof may be more readily sensed by the pickup 1100. In yet another embodiment, one or more soft magnetic elements may be positioned anywhere on the head of the instrument. Preferably, a musician may tune the sound of the pickup to his or her taste by manipulating the position of one or more soft magnetic elements 1600 on the head.

When installed as shown in FIG. 1, the disclosed pickup assembly 1000 for stringed musical instruments suitably may have improved acoustic sound quality. In one embodiment, the pickup features three mechanisms for converting the mechanical vibrations of the instrument into an electric signal: first, the electromagnets 1120 of the pickup 1100 are suitably for converting the vibrations of the instruments 2000 strings into an electric signal; second, the acoustic chambers 1110 converting the vibrations of the sound box (e.g. sound waves) into an electric signal via movement of the magnets relative to one another; and third, a soft-magnetic element 1600 for allowing the vibrations of the instruments head to modulate the magnetic flux of the pickup 1100 and thereby produce an electric signal. In a preferred embodiment, sound quality may be controlled via plugging one or more of the acoustic chambers 1110 with a solid material such as plastic or wood. What is more, plugging the center chamber 1110 may reduce feedback that is the result of playing the instrument at high volumes. Tests have been conducted to determine the output of a pickup constructed of chambers 1110. In said tests, a control pickup with chambers filled with plastic features an FFT Level Ch1 output of −93.3 dBV at a frequency of 131 Hz. A pickup with three chambers as shown in the figures featured an output of −91.0 dBV at a frequency of 131 HZ. A pickup with three chambers as shown in the figures, but with a wood core positioned in the center chamber, featured an output of −92.8 dBV at a frequency of 131 HZ. A pickup with three chambers as shown in the figures, but with wood cores positioned in the outside chambers, featured an output of −92.7 dBV at a frequency of 131 HZ. A pickup with three chambers as shown in the figures, but with wood cores positioned in the center chamber, featured an output of −93.2 dBV at a frequency of 131 HZ.

It should be noted that FIGS. 1 through 13L and the associated description are of illustrative importance only. In other words, the depiction and descriptions of the present invention should not be construed as limiting of the subject matter in this application. Additional modifications may become apparent to one skilled in the art after reading this disclosure.

I claim:

1. A pickup comprising:

a first magnet coiled by a first electric conductor;

a second magnet coiled by a second electric conductor;

a first, a second, and a third acoustic chambers;

electric circuitry coupled to said electromagnet for extracting electric signals therefrom;

wherein the first magnet is positioned between the first and second acoustic chambers; and, wherein the second magnet is positioned between the second and third acoustic chambers.

2. The pickup of claim 1 further comprising a soft-magnetic element positioned on an acoustic element of a musical instrument to which the pickup is attached.

3. The pickup of claim 2 wherein the second acoustic chamber is filled with wood.

4. The pickup of claim 2 wherein the second acoustic chamber is filled with plastic.

5. The pickup of claim 1 wherein any of said first, second, and third acoustic chambers are about 0.125 inches wide, 2.875 inches wide, and 0.560 inches high.

6. A method of improving the acoustic quality of electronic sounds comprising the steps of:

Securing a pickup with a coiled electromagnet and at least one acoustic chamber to a stringed musical instrument inside of a sound box of the instrument;

securing a soft magnetic element to an acoustic element of the musical instrument so that said magnetic element moves relative to the electromagnet whenever the instrument is played;

playing the musical instrument so that any movements of the acoustic element result in a modulation of the magnetic flux the electromagnet to produce an electric current.

7. The method of claim 6 further comprising the step of filling the acoustic chamber with wood.

8. The method of claim 6 further comprising the step of filling the acoustic chamber with plastic.

9. The method of claim 6 further comprising the step of positioning the pickup on a neck extension rod of the musical instrument at a distance of between zero and 3.750 inches from a neck extension rod.

10. The method of claim 9 further comprising the step of positioning the pickup at a distance of about 0.030 inches from a head of the instrument.

11. The method of claim 10 further comprising the steps of positioning the soft magnetic element in between the head and pickup.

12. The method of claim 10 further comprising the steps of playing the musical instrument so that vibrations of a sound box of the instrument enter the acoustic chamber and result in vibrations of the electro magnet.

13. A musical instrument comprising:

a sound box;

a neck with at least one neck extension rods through the sound box;

a head;

at least one metallic string;

a pickup assembly installed on said at least one neck extension rods, said pickup assembly comprising a first magnet coiled by a first electric conductor, a first acoustic chamber, wherein the first magnet is positioned adjacent to the first acoustic chamber; and, an output jack that is electrically coupled to said first electromagnet.

14. The musical instrument of claim 13 further comprising:

a second magnet coiled by a second electric conductor;

a second acoustic chamber;

wherein the second electromagnet is positioned adjacent to the second acoustic chambers; and, the output jack is electrically coupled to said second electromagnet.

15. The musical instrument of claim 14 further comprising a third acoustic chamber that is positioned in between said first and second electromagnets.

16. The pickup of claim 13 further comprising a soft-magnetic element positioned on an acoustic element of a musical instrument to which the pickup is attached.

17. The pickup of claim 14 further comprising a soft-magnetic element positioned on an acoustic element of a musical instrument to which the pickup is attached.

18. The pickup of claim 17 wherein the second acoustic chamber is filled with wood.

19. The pickup of claim 17 wherein the second acoustic chamber is filled with plastic.

20. The pickup of claim 13 wherein any of said first, second, and third acoustic chambers are about 0.125 inches wide, 2.875 inches wide, and 0.560 inches high.

* * * * *